US005104683A

United States Patent [19]

Robertson

[11] Patent Number: 5,104,683

[45] Date of Patent: Apr. 14, 1992

[54] SINGLE LAYER MULTI-COLOR LUMINESCENT DISPLAY AND METHOD OF MAKING

[75] Inventor: James B. Robertson, Yorktown, Va.

[73] Assignee: The United States of America as represented by the Administrator of the National Aeronautics and Space Administration, Washington, D.C.

[21] Appl. No.: 693,049

[22] Filed: Apr. 30, 1991

Related U.S. Application Data

[60] Continuation of Ser. No. 337,768, Apr. 13, 1989, abandoned, which is a division of Ser. No. 140,185, Dec. 31, 1987, Pat. No. 4,903,193.

[51] Int. Cl.[5] ..... B05D 3/06; B05D 5/06

[52] U.S. Cl. ..... 427/38; 427/66; 427/68; 427/108; 427/109; 427/126.1; 427/282; 427/372.2

[58] Field of Search ..... 427/38, 68, 282, 372.2, 427/108, 126.1, 109

[56] References Cited

U.S. PATENT DOCUMENTS

| | | | |
|---|---|---|---|
| 4,121,010 | 10/1978 | Lasky et al. | 427/64 |
| 4,341,571 | 7/1982 | Hiss et al. | 427/43.1 |
| 4,717,606 | 1/1988 | Hale | 428/1 |
| 4,733,128 | 3/1988 | Tohida et al. | 313/503 |
| 4,792,500 | 12/1988 | Kojima | 428/690 |
| 4,862,033 | 8/1989 | Migita et al. | 313/502 |
| 4,877,994 | 10/1989 | Fuyama et al. | 313/503 |

OTHER PUBLICATIONS

Proceedings of the SID. vol. 25, No. 1984, Kitai et al., Los Angeles, Calif. "Two Color Thin Film Electroluminesce With Spatially Selective Activator Doping".

*Primary Examiner*—Janyce Bell
*Attorney, Agent, or Firm*—Kevin B. Osborne

[57] ABSTRACT

The invention is a multi-color luminescent display 10 comprising an insulator substrate 11 and a single layer of host material 13 which may be a phosphor deposited thereon that hosts one or more different impurities 14, therein forming a pattern of selected and distinctly colored phosphors such as blue, green and red phosphors in the single layer of host material 13. Transparent electrical conductor means 12 may be provided for subjecting selected portions of the pattern of colored phosphors to an electric field thereby forming a multi-color, single layer electroluminescent display.

A method of forming a multi-color luminescent display 10 includes the steps of depositing on an insulator substrate a single layer of host material which itself may be a phosphor with the properties to host varying quantities of different impurities 14; and introducing one or more of said different impurities into selected areas of said single layer of host material as by thermal diffusion or ion-implantation to form a pattern of phosphors of different colors in said single layer of host material.

23 Claims, 3 Drawing Sheets

SINGLE LAYER MULTI-COLOR LUMINESCENT DISPLAY AND METHOD OF MAKING

ORIGIN OF THE INVENTION

The invention described herein was made by an employee of the United States Government and may be manufactured and used by or for the Government for governmental purposes without the payment of any royalties thereon or therefor.

This is a continuation of application Ser. No. 07/337,768 filed Apr. 13, 1989, now abandoned, which is a divisional application of pending Ser. No. 07/140,185, filed Dec. 31, 1987, U.S. Pat. No. 4,903,193.

BACKGROUND OF THE INVENTION

1. Field of the Invention

The invention is a single layer multi-color luminescent display and method of making and more particularly to thin-film electroluminescent displays.

Thin-film, multi-color electroluminescent (TFEL) flat-panel displays, because of their potential to provide improved flexibility and reliability, reduce weight, space, power consumption and degration characteristics, are finding greater use in the control panels of air, space and ground vehicles and many other applications requiring thin, flat, mutli-colored displays.

2. Description of the Prior Art

Full-colored electroluminescent displays formed of patterned and stacked layers of phosphors separated by insulating layers and transparent conductors and frequently filters are generally known. For instance, see U.S. Pat. No. 4,689,522, dated Aug. 25, 1987 which discloses a full-color, thin-film electroluminescent device with two stacked substrates and color filters. Multicolor electroluminescent displays formed by depositing side-by-side stripes of different colored phosphors on a common insulator substrate are also known Conventional electroluminescent (EL) displays are generally divided into two major types according to the manner or form in which the phosphors are applied to the necessary substrate. These are thin-film electroluminescent (TFEL) and powder electroluminescent (powder EL) devices.

Powder EL devices are formed by grinding the phosphor crystals to be used into a powder, mixing the powder with a binder and a solvent, and then spreading the mixture (single color) onto a substrate by spraying or blading. TFEL devices are formed by growing the phosphors (single color) on a substrate using conventional techniques such as vapor deposition or sputtering.

Typically, the thickness of the phosphors layer in EL devices is about 20 to 40 $\mu$M while the thickness of the phosphors layer in a TFEL device is 0.4 to 0.5 $\mu$M. As is known the luminescence in a TFEL device is produced by a different mechanism in a powder EL device.

To display the full color spectrum including white, a conventional TFEL device will typically have the three primary and separate colors, blue, green and red phosphors, placed close together either side-by-side on the same substrate; on separate superimposed layers, or in some combination of these two fabrication techniques.

Typically, the three phosphors are applied to the substrate or substrates (in thickness of 2000 to 5000 Angstroms) by vacuum deposition. In conventional single layer TFEL devices alternating stripes of blue, green and red phosphors are grown on a glass substrate. In a two-layer TFEL device such as disclosed in U.S. Pat. No. 4,689,522, a single layer of blue phosphor is superimposed over a single layer of side-by-side alternating stripes of green and red phosphors.

The fabrication of a conventional multi-color TFEL device is generally as follows: After depositing a pattern of transparent electrodes on the surface of a glass substrate and covering it with a transparent layer of insulation, the following steps are performed: (1) a red phosphor is deposited as previously described over the insulated surface of the substrate: (2) the phosphor coated surface is masked with a striped pattern (commonly with photo-resist); (3) plasma etching of the red phosphor; (4) removal of the photo-resist; (5) deposition of a green phosphor; (6) the addition of an insulating layer; (7) the repetition of steps (2), (3), and (4), after the deposition of each additional colored phosphor; and (8) annealing of the phosphors. Variations in this process may be made by changing the order and repetition of the above steps or by ion-beam etching instead of plasma etching.

As is apparent, a disadvantage of the prior art is the necessity of the etching steps, the depths and locations of which must be precisely controlled. For instance, in the first etching step, the etching must continue through the full depth of the red phosphor layer but must be stopped before going into the insulating layer. In the second etching step, the etching must continue through the full depth of the green phosphor but stop before entering the red phosphor layer. The etching also leaves an uneven surface on the underlying phosphor layer that is believed to promote dielectric breakdown in the covering insulating layer applied after etching is completed.

OBJECTS AND SUMMARY OF THE INVENTION

An object of this invention is to provide a single-layer, multi-color luminescent display and method of making same.

Another object is to provide a multi-color luminescent display using a single-layer of a host material that may be a phosphor material with the properties to serve as a host to different impurities that form different colored phosphors in the single-layer of host material.

The above and numerous other objects are achieved by the invention which is a full colored, luminescent dispaly that includes a single layer of a host material that itself may be a phosphor on an insulating substrate, the host layer, serving as host to different impurities that combine therewith in selected areas on said single host layer to form a pattern of phosphors of different colors. The impurities may be introduced into the host and single-layer of material, which also may be a phosphor, by thermal diffusion, ion implantation or the like. The number of phosphors of different colors that may be provided is determined by the number and quantity of different impurities to which the single-layer of host material can serve as a host.

BRIEF DESCRIPTION OF THE DRAWING

The above and numerous other objects and advantages of the invention will become apparent from the following detailed description when read in view of the appended drawing wherein.

DESCRIPTION OF THE PREFERRED EMBODIMENT

Figure 1:
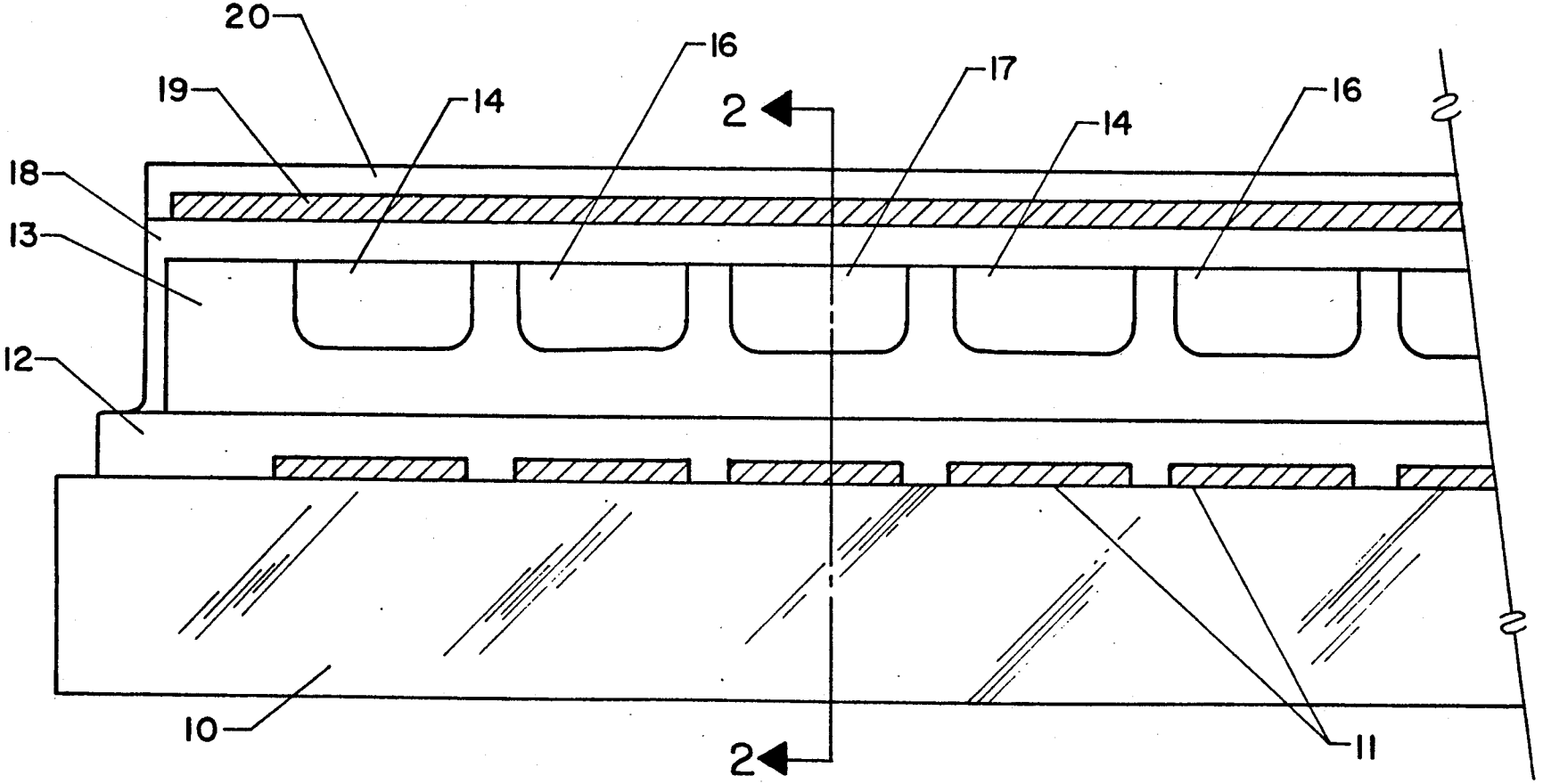
FIG. 1 is a sectional view illustrating a preferred embodiment of a single layer, three-color electroluminescent display and the method of making same in accordance with the invention.

As shown in FIG. 1, a preferred embodiment of the invention includes an insulating substrate 10 of glass or the like upon which a pattern of individual transparent column electrical conductors 11 is deposited before an insulating covering or layer 12 of $SiO_2$ or other suitable dielectric is applied over the column conductors 11 as is well known. Next, a single layer 13 of a host material such as ZnS is deposited by evaporation, sputtering, or other known thin film deposition technique.

The single layer of host material 13 serves as a common host to two or more different impurities that when introduced into the common host material 13 in selected areas form a pattern of stripes, dots or other indicia of different colored phosphors in the single-layer of host material 13. As will be explained the single layer of host material 13 may be either luminescent or non-luminescent provided it has the properties to serve as a common host to different phosphor forming impurities.

For instance, as shown in FIG. 1, a green phosphor stripe 14 is produced by introducing the impurity $TbF_3$ to form $ZnS:TbF_3$. A red phosphor stripe 16 is achieved by introducing the impurities $TbF_3$ and Mn into the host layer 13 of ZnS. A blue phosphor stripe 17 results by introducing the impurity Mg to the host layer 13 of ZnS to form ZnS:Mg. Thus, by adding different impurities to a single-layer of a host material 13 in selected areas, a pattern of phosphors of different colors is provided in the single layer of host material.

After annealing the layer of host material 13 and the phosphors 14, 16, and 17 formed therein, a second transparent layer 18 of $SiO_2$ or other suitable dielectric is applied over the layer of host material 13. A pattern of row electrical conductors 19 is deposited over the dielectric layer 18. The column and row conductors 11 and 19 form a matrix permitting selected portions of the layer of host material 13 to be subjected to an electric field established between the column and row conductors as is well known.

A preferred method of making a single layer electroluminescent display begins with a glass substrate 10 upon which a pattern of transparent and individual column conductors 11 of the indium-tin oxide is deposited and over which a covering insulator layer 12 of $SiO_2$ or other suitable dielectric is deposited as by sputtering or other conventional deposition techniques.

Thereafter a single layer of host material 13 of ZnS or a phosphor of a selected color capable of hosting one or more impurities to form phosphors of different colors is deposited by evaporation, sputtering or other known thin film deposition technique over the entire surface of the insulator layer 12. The host layer 13 of ZnS is then covered with a metal mask to form a predetermined pattern of exposed and unexposed surface areas on the host layer 13 as required to form the desired electroluminescent display. Thereafter the impurity $TbF_3$ is introduced in sufficient quantity through the mask or photoresist into the host layer 13 of ZnS to produce one or more stripes 14 of green phosphor $ZnS:TbF_3$. The mask is then repositioned on the surface of the host layer 13 of ZnS to form the next required pattern of exposed and unexposed surface areas on the host layer 13 of ZnS before the impurities $TbF_3$ and Mn are introduced into the newly exposed areas of the host layer 13 in sufficient quantity to form one or more stripes 16 or red phosphor $ZnS:TbF_3:Mn$.

Again the metal mask is repositioned to form a third pattern of exposed areas on the surface of the host layer 13 of ZnS. Thereafter the impurity Mg is introduced into the newly exposed areas of the host layer 13 in sufficient quantity to form one or more stripes 17 of blue phosphor ZnS:Mg. Thus, a full-color luminescent display surface is achieved. The impurities may be introduced into the host layer 13 by thermal diffusion, ion-implantation or other suitable techniques.

After annealing the host layer 13 and the phosphor stripes 14, 16 and 17 therein, a pattern of individual, transparent row electrical conductors 19 embedded in a second transparent layer 18 of $SiO_2$ or other suitable dielectric material is applied over the host layer 13, the $SiO_2$ forming an insulator between the phosphor stripes 14, 16 and 17 and the row electrical conductors 19 which with the column electrical conductors 11 form a matrix for subjecting selected portions of the phospor stripes 14, 16 and 17 to an electric field to provide an electroluminescent display.

As mentioned luminescent and electroluminescent displays can be made in accordancce with the invention using any single layer 13 of host material into which impurities can be introduced to form phosphors of different colors in the single layer of host material. For example, the phosphors $SrS:Ce_2S_3$ (red) and $SrS:CeF_3$ (green) may be formed in a single host layer 13 of SrS to provide two distinct colors.

Figure 3:
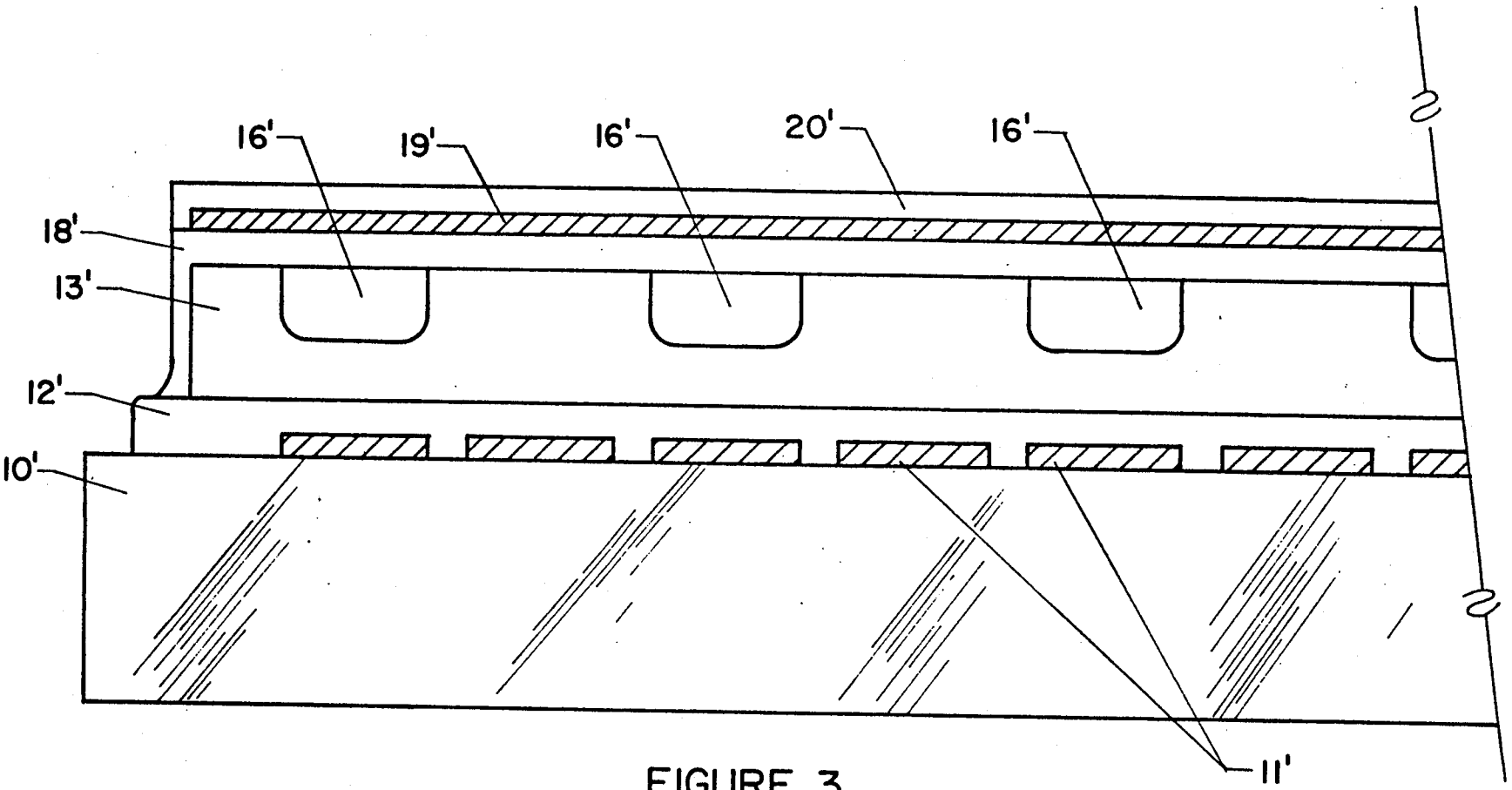
FIG. 3 is a sectional view illustrating a single layer, two-color display and method of making same in accordance with the invention.

As shown in FIG. 3, luminescent and electroluminescent displays of two or more colors may be made in accordance with the invention using the green phosphor $ZnS:TbF_3$ as the single layer 13' of host material into which the impurity Mn is introduced as previously described to form stripes 16' of the red phosphor $ZnS:TbF_3:Mn$. The number of phosphors of different colors that can be formed again is determined by the number of different impurities the single layer 13' of phosphor is able to host as previously explained.

Figure 2:
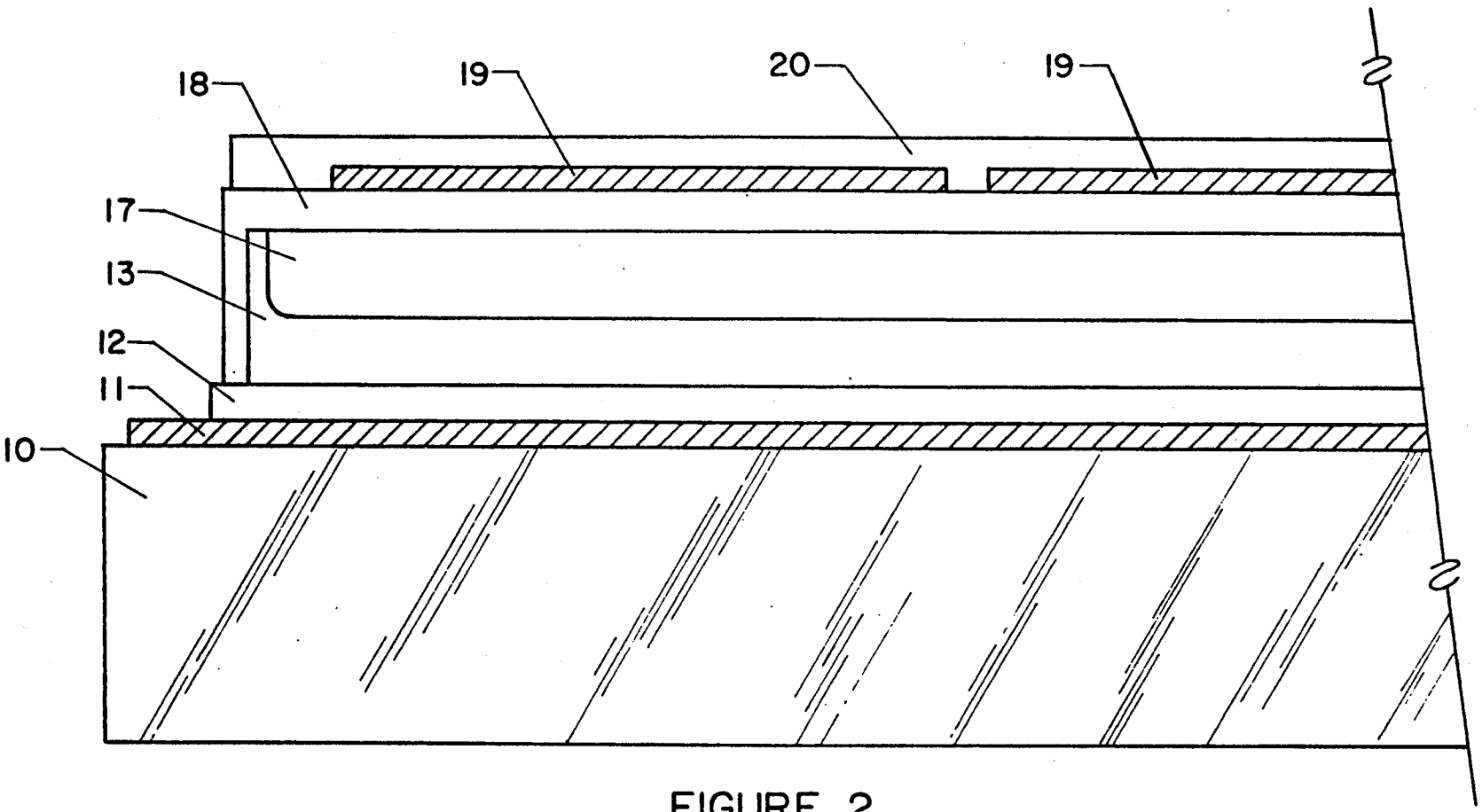
FIG. 2 is a cross-sectional view taken along the lines 2—2 in FIG. 1.

As shown in FIG. 3 an electroluminescent display may be fabricated as shown in FIGS. 1 and 2, like elements having the same reference numeral except for the prime (') symbol—thus, 13 and 13' identifying the different single layers of host material in the two embodiments. As is shown, the method of this invention eliminates the need for the difficult and costly steps of etching, thereby increasing the yield while reducing the cost of making full or multi-color thin film luminescent and electroluminescent displays.

Depositing only a single layer of host material on an insulator substrate, leaves a smooth top surface on the single layer. This eliminates the sharp corners and edges left by the overlapping layers of phosphor in conventional, multi-layer TFEL displays. Such an irregular, rough surface may cause corresponding sharp corners in the succeeding layers of insulation and transparent conductors leading to a dielectric breakdown of the insulating layers.

While the invention has been described as a multicolor, single layer electroluminescent display device (TFEL) and a method of making the same, the method of this invention may be used to make a multi-color, single phosphor layer substrate for use in cathode ray tubes and other similar applications requiring a multi-color phosphor display surface.

While preferred embodiments of a multi-color, single phosphor layer electroluminescent display and methods of making same have been described in detail, numerous changes and modifications can be made within the principles of the inventions which are to be limited only by the appended claims.

What is claimed is:

1. A method of forming a multi-color luminescent surface on a substrate comprising the steps of:

depositing a single layer of host material formed of ZnS having a smooth top surface on said substrate; and introducing sufficient quantities of Mg, $TbF_3$ and Mn within selected areas of said single layer of ZnS host material via an appropriately positioned mask to form a pattern of different colored phosphors namely:ZnS:Mg (blue); ZnS:$TbF_3$ (green); and ZnS:Mn:$TbF_3$ (red), respectively, within said single layer of ZnS host material such that the top surface of said single layer of host material remains smooth.

2. The method as defined in claim 1 wherein the quantities of Mg, $TbF_3$ and Mn are introduced into said single layer of ZnS host material by means of thermal diffusion.

3. The method as defined in claim 1 wherein the quantities of Mg, $TbF_3$ and Mn are introduced into said single layer of ZnS host material by means of ion-implantation.

4. The method as defined in claim 1 including a third step of depositing an insulating layer over said smooth top surface of said single layer of ZnS host material.

5. A method of forming an electroluminescent display comprising the steps of:

forming a pattern of electrical conductor means on an insulator substrate;

depositing a single layer of host material formed of ZnS and having a smooth top surface on said substrate;

introducing sufficient quantities of Mg, $TbF_3$ and Mn within selected areas of said single layer of ZnS host material via an appropriately positioned mask to form a pattern of different colored phosphors namely: ZnS:Mg (blue); ZnS:$TbF_3$ (green); and ZnS:Mn:$TbF_3$ (red), respectively, within said single layer of host material such that the top surface of said single layer of host material remains smooth;

depositing an insulating layer over said smooth top surface of said single layer of ZnS host material; and energizing said electrical conductor means to subject selected areas of said insulator substrate to an electric field thereby forming an electroluminescent display.

6. The method as defined in claim 5 wherein the quantities of Mg, $TbF_3$ and Mn are introduced into said single layer of ZnS host material by means of thermal diffusion.

7. The method as defined in claim 5 wherein the quantities of Mg, $TbF_3$ and Mn are introduced into said single layer of ZnS host material by means of ion-implantation.

8. A method of forming a multi-color luminescent surface on a substrate comprising the steps of:

depositing a single layer of host material of SrS having a smooth top surface on said substrate; and introducing sufficient quantities of $Ce_2S_3$ and $CeF_3$ within selected areas of said single layer of SrS material via an appropriately positioned mask to form a pattern of different colored phosphors, namely SrS:$Ce_2S_3$ (red) and SrS:$CeF_3$ (green), within said single layer of host material such that the top surface of said single layer of host material remains smooth.

9. The method as defined in claim 8 wherein the quantities of $Ce_2S_3$ and $CeF_3$ are introduced into said single layer of SrS host material by means of thermal diffusion.

10. The method as defined in claim 8 wherein the quantities of $Ce_2S_3$ and $CeF_3$ are introduced into said single layer of SrS host material by means of ion-implantation.

11. The method as defined in claim 8 including a third step of depositing an insulating layer over said smooth top surface of said single layer of SrS host material.

12. A method of forming an electroluminescent display comprising the steps of:

forming a pattern of electrical conductor means of an insulator substrate;

depositing a single layer of host material formed of SrS having a smooth top surface on said substrate;

introducing sufficient quantities of $Ce_2S_3$ and $CeF_3$ within selected areas of said single layer of SrS material via an appropriately positioned mask to form a pattern of different colored phosphors namely, SrS:$Ce_2S_3$ (red) and SrS:$CeF_3$ (green), within said single layer of host material such that the top surface of said single layer of host material remains smooth;

depositing an insulating layer over said smooth top surface of said single layer of SrS host material; and energizing said electrical conductor means to subject selected areas of said insulator substrate to an electric field thereby forming an electroluminescent display.

13. The method as defined in claim 12 wherein the quantities of $Ce_2S_3$ and $CeF_3$ are introduced into said single layer of SrS host material by means of thermal diffusion.

14. The method as defined in claim 12 wherein said the quantities of $Ce_2S_3$ and $CeF_3$ are introduced into said single layer of SrS host material by means of ion-implantation.

15. A method of forming a multi-color luminescent surface on a substrate comprising the steps of:

depositing a single layer of host material forming one color having a smooth top surface on said substrate, said single layer of host material having the properties to host one or more different impurities therein; and introducing sufficient quantities of one or more of said impurities within selected areas of said single layer of host material via an appropriately positioned mask to form a pattern of phosphors of different colors within said single layer of host material of one color such that the top surface of said single layer of host material remains smooth.

16. The method as defined in claim 15, wherein said single layer of host material is formed of phosphor ZnS:$TbF_3$ (green) and said one impurity hosted therein is Mn to form another, different colored phosphor therein, namely ZnS:$TbF_3$:Mn (red).

17. The method as defined in claim 15 wherein said different impurities are introduced into said single layer of host material by means of thermal diffusion.

18. The method as defined in claim 15 wherein said different impurities are introduced into said single layer of host material by means of ion-implantation.

19. The method as defined in claim 15 including a third step of depositing an insulating layer over said smooth top surface of said single layer of host material.

20. A method of forming an electroluminescent display comprising the steps of:

forming a pattern of electrical conductor means on an insulator substrate;

depositing a single layer of host material forming one color having a smooth top surface on said substrate, said single layer of host material having the properties to host one or more different impurities therein:

introducing sufficient quantities of one or more of said impurities within selected areas of said single layer of host material via an appropriately positioned mask to form a pattern of phosphors of different colors within said single layer of host material of one color such that the top surface of said single layer of host material remains smooth;

depositing an insulating layer over said smooth top surface of said single layer of host materials; and energizing said electrical conductor means to subject selected areas of said insulator substrate to an electric field thereby forming an electroluminescent display.

21. The method as defined in claim 20, wherein said single layer of host material is formed of the phosphor $ZnS:TbF_3$ (green) and said one impurity hosted therein is Mn to form another, different colored phosphor therein, namely $ZnS:TbF_3:Mn$ (red).

22. The method as defined in claim 20 wherein said different impurities are introduced into said single layer of host material by means of thermal diffusion.

23. The method as defined in claim 20 wherein said different impurities are introduced into said single layer of host material by means of ion-implantaton.

* * * * *